US005553863A

United States Patent [19]

Wynne

[11] Patent Number: 5,553,863

[45] Date of Patent: Sep. 10, 1996

[54] FLEXIBLE TWO-SIDED MULTIPLE-SPORT GOAL

[76] Inventor: Martin O. Wynne, 3972 Rosemond Rd., Cleveland Heights, Ohio 44121

[21] Appl. No.: 570,532

[22] Filed: Dec. 11, 1995

[51] Int. Cl.[6] ..... A63B 63/00

[52] U.S. Cl. ..... 273/402; 273/400; 273/127 B; 273/411

[58] Field of Search ..... 273/398, 400, 273/402, 127 A, 181 F, 411, 399, 401, 402, 26 A, 127 R, 127 B; 473/197

[56] References Cited

U.S. PATENT DOCUMENTS

| | | | |
|---|---|---|---|
| 2,449,708 | 9/1948 | Lindsay | 273/127 B |
| 3,865,375 | 2/1975 | Cosgrove | 273/118 R |
| 3,979,120 | 9/1976 | Dietrich | 273/127 B |
| 4,664,384 | 5/1987 | Solla | 273/127 B |
| 4,702,478 | 10/1987 | Kruse | 273/127 B |
| 4,842,284 | 6/1989 | Rushing et al. | 273/26 A X |
| 5,000,461 | 3/1991 | Borazjani | 273/400 |
| 5,039,100 | 8/1991 | Cortese | 273/127 B |
| 5,048,844 | 9/1991 | Haseltine | 273/400 |
| 5,080,375 | 1/1992 | Moosaui | 273/400 |
| 5,244,213 | 9/1993 | Armell | 273/400 |

*Primary Examiner*—Mark S. Graham

[57] ABSTRACT

An adjustable game goal apparatus composed of a flexible chord held in an arc position by insertion into the inner coils of two springs. The springs are attached to a flat smooth surfaced base plate by means of suction cups. The base plate has spikes attached to its underside to secure the goal to the ground. For indoor use the base plate is not needed and the goal is attached to a smooth floor by means of the suction cups. The goal is open to receive shots from the front or back perspective. It is designed to give way, allowing a shot to continue in its original direction, then to return to its normal upright position. The size of the goal is adjustable by means of controlling the length of the chord resting within the springs' coils.

6 Claims, 1 Drawing Sheet

FLEXIBLE TWO-SIDED MULTIPLE-SPORT GOAL

BACKGROUND-FIELD OF INVENTION

This invention relates to sports goals, specifically to such goals used for practicing or playing a number of different games.

BACKGROUND-DESCRIPTION OF PRIOR ART

This invention was designed to play a game I have developed called Wall Soccer. The game enables two players to play a soccer style game within a racquetball or four-sided handball court. Wall soccer requires a goal that can be attached temporarily to the floor of a racquetball or handball court. The Wall Soccer goal is designed to be easily set up and taken down and requires no additional hardware be attached to the racquetball court.

In Wall Soccer shots at the goal are made from either side of the court. There is no distinguishable front or rear side of the goal. In addition, when the goal is struck by the ball the goal must be flexible enough to allow the ball to continue in the same direction relatively unimpeded. Once struck, the goal must have sufficient rigidity and structural integrity to automatically return to its original position and shape.

The manner of using the flexible, two-sided multiple-sport goal is very different from any other goal currently being used. In Wall Soccer the ball must be hit off the wall of a racquetball court and enter the goal from the opponent's side of the goal. In order to satisfy the game's requirements, the goal must be stationary and securely attached to the floor. In addition, because of the close confines of a racquetball court, the goal must be flexible enough to be safe if kicked, stepped on or fallen into.

Although the goal is designed for use in Wall Soccer on a racquetball or handball court, use of this goal is not limited to Wall Soccer. It can be used as a practice goal for a number of sports and can be adjusted to meet requirements for both indoor and outdoor use and for use in a swimming pool area. The indoor goal adheres to the floor by means of suction cups. For outdoor use the suction cup is attached to a smooth plate secured to the ground by means of a number of spikes. The suction cups also allow the goal to be attached to the tile normally used in a swimming pool. The size of the goal's opening can also be easily changed to meet requirements for other uses.

The features designed for wall soccer can be of value to coaches and physical education instructors in playing both indoor and outdoor games. The simplicity, ease of set up and storage and safety features make it a preferable replacement to current goals now in use. There are a variety of goals available which provide safety, flexibility, adjustable size, easy setup, or adaptability for indoor and outdoor use but none offer all these qualities in the same goal structure.

Physical education classes play a number of games that are variations or combinations of popular sports. Games like floor hockey, indoor soccer and speedball all require use of an indoor goal of some kind. The goals used for such sports generally are portable versions built similar to the official style required for the sport. Hockey, water polo or soccer style goals are typical examples. However, instructors and coaches sometimes find that having official equipment in practices and informal games is not as important a consideration as factors such as safety and ease of setup and storage.

Outside practices often employ goals that are already established for that sport. Football goal posts and soccer nets are built into the field. Field hockey and lacrosse goals are usually readily available on the field. Use of these goals is not always ideal but instructors tend to use them because too much inconvenience is required in the process of taking other goals in and out of storage and setting them up.

During practices some coaches like to be able to adjust the size of the goal. The ability to match the size or skills of the player to the size of the goal can be very helpful, especially when practicing a particular skill. Some goals are designed to be adjusted to different sizes but most require considerable reconstruction to change sizes.

In areas where the field is subject to frequent wet weather there is a significant disadvantage to using existing permanent goals. Practicing in front of the permanent goals can cause serious field problems because the area in front of the goal is often left in poor condition. Soccer goals in particular tend to develop a mud puddle at the goal mouth because of overuse in wet weather. Most goals are not sufficiently portable to allow the goal to be moved each time the goal mouth becomes too damaged.

Every athletic sport requiring use of a goal has specified structure and size requirements. Most goals are built as relatively rigid structures so that the ball deflects off the goal. No commonly played sports require a goal that can be entered from both sides and none are constructed with a flexibility that enables the goal to give way after being hit and then automatically return to its original position to receive a return shot.

The disadvantages of the different styles of goals now in use can be significant.

(a) Goals that are designed to match the official requirements of particular games are of a rigid design. Matching the required specifications often makes the goals less safe than necessary, particularly to young or inexperienced players. The rigidity allows little flexibility when a player falls or steps on the goal or is pushed into such a goal. No patents for a soccer goal of any official or practice type were found that collapse upon impact. U.S. Pat. No. 4,664,384 does provide a flexible hockey frame designed to collapse upon impact and then return to its original form.

(b) Goals that are preassembled or almost completely assembled tend to be difficult to store or transport. Others that are convenient to store and transport usually require some effort to set up. U.S. Pat. No. 4,702,478 is an example typical of such goals, providing a collapsible frame consisting of a minimum of thirteen parts to set up and take apart.

(c) For most goals the size and rigidity of a structure that needs to be set up and taken down makes it difficult to use a large number of such goals for team practice. U.S. Pat. No. 3,865,375 provides a tubular hoop target designed for outdoor use that is easy to set up and store, but it is rigid, attaches to the ground by use of spikes and is not useable indoors.

(d) Some goals are not designed to be adjustable or are difficult to adjust. U.S. Pat. No. 5,080,375 provides a goal that can be adjusted to different sizes but consists of many parts requiring reconfiguration when the size is changed.

(e) Complexity and a large number of parts also tends to increase the cost of most portable goals. The cost can limit the number of such goals that can be provided for practice use. In addition, loss of a single individual part can make the goal unusable.

(f) Goals normally have only one side open receive shots. In practice a missed shot requires that the ball be retrieved and returned to the front of the goal. Goals are not normally designed to be entered from opposite directions. U.S. Pat. No. 4,842,284 provides a two way practice soccer goal that can be shot at from either front or rear direction. U.S. Pat. No. 5,048,844 offers a similar practice goal designed to rebound a shot taken from either front or rear. For both the framework is rigid, attached to the ground by means of spikes and designed for outdoor use.

(g) There are no goals available that meet all the requirements of the game Wall Soccer. In Wall Soccer the goal structure must be open to shots from two sides, have a safe flexible design that automatically returns to its original structure after being hit, and be easily attached and removed from a racquetball or handball floor. No patent was found that could satisfy all of the Wall Soccer requirements.

OBJECTS AND ADVANTAGES

Accordingly, besides the objects and advantages of the flexible two-sided goal described above, several objects and advantages of the present invention are:

(a) to provide a goal which has sufficient flexibility to bend when hit, while still having the structural integrity to return to its original position after being hit, as required in the game Wall Soccer;

(b) to provide a goal which enables shots to enter from either side;

(c) to provide a goal that can attach to a smooth floor without requiring special hardware;

(d) to provide a goal whose size can be quickly and easily adjusted and can be reduced to a size that requires minimal space for easy storage;

(e) to provide a highly safe goal designed to allow a maximum amount of flexibility in order to help reduce the possibility of injuries should any players run into, fall on or hit the goal in ways that commonly happen in athletic competition;

(f) to provide a piece of equipment that can be set up, dismantled and placed in a new position, both indoors and outdoors, with minimal time or effort;

(g) to provide a goal which is sufficiently lightweight and easily portable and which allows a large number to be carried with little effort or inconvenience;

(h) to provide a goal that can be placed anywhere on an outdoor field without damaging the playing field and can be moved easily and quickly to another position should the turf become overused;

(i) to provide a goal that is constructed with a minimum number of simple but sturdy parts that are unlikely to be damaged or to become inoperable;

(j) to provide an alternative goal choice for physical education instructors and coaches who would like to use a style different from the official standardized goals required for the different sports;

(k) to provide a goal that is easily adapted to create new ideas for play or practice or to create new games or variations to traditional games;

(l) to provide a new type of goal for creating new games based on the concept of placing the goal between opposing teams.

DRAWING FIGURES

Figure 1:
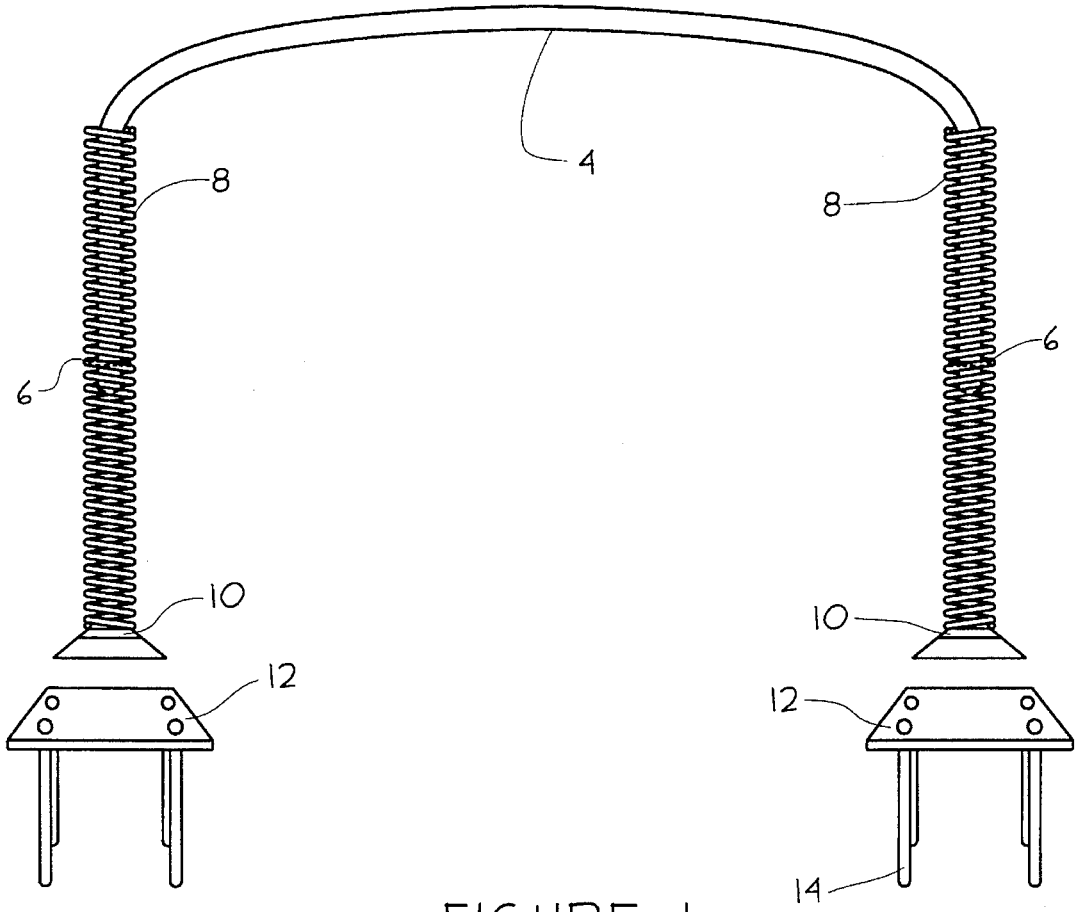
FIG. 1 shows a view of the goal which is identical from front and rear view.

| Reference Numerals In Drawing | |
|---|---|
| 4 chord | 6 staple |
| 8 spring | 10 suction cup |
| 12 base | 14 spike |

DESCRIPTION-FIGS. 1 TO 2

A typical embodiment of the present invention is illustrated in FIG. 1. A round flexible elastic chord 4 with staples 6 attached at each end rests within the two springs 8 which support the chord 4. At the opposite end of each spring 8 is attached a suction cup 10. Each cup 10 rests on a base plate 12 with spikes 14 attached. The chord 4 has sufficient structural rigidity to enable it to form an arc between the springs 8.

The spring 8 is sufficiently rigid to maintain an upright position at a 90 degree angle to the floor or ground. The suction cup 10 is attached to the spring 8 by inserting the non-suction end into the interior of the spring. The suction cup 10 produces a sufficiently strong suction to hold the entire structure securely to the base plate 12 or to the floor.

Figure 2:
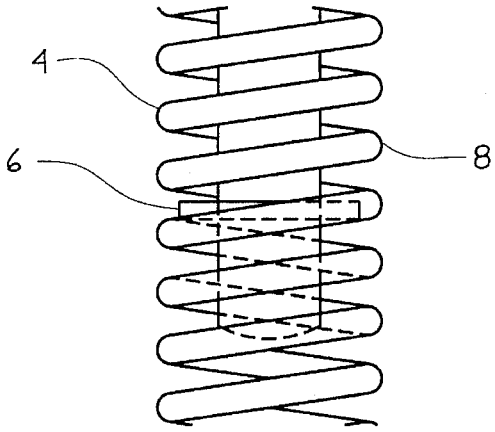
FIG. 2 shows a detailed view of the elastic chord with its attached staple and the seating of the chord and staple as within the spring.

FIG. 2 is a detailed view of the connection of the chord 4 to the interior of the spring 8 within which the chord 4 sits. The configuration of the connection of the chord 4 and with staple 6 attached is shown at the point where the staple 6 rests within the coils of the springs 8. The staple 6 attached to the end of the chord 4 is longer than the inside diameter of the spring 8 and rests with each end projecting between the coils of the spring 8. The staple 6 is sufficiently long to seat securely between the coils of the spring 8 but is no larger than the outside diameter of the spring 8.

OPERATION - FIGS. 1, 2

The operation of the game goal has three major features; adjustable size, easily adaptable setup for indoor or outdoor use, and flexible structure.

The goal is designed to enable the size to be adjustable. The base plates spikes 14 are pressed into the ground so that the plate 12 sits in level position. Base plates 12 are placed at the desired goal width. The size is then adjusted by twisting the springs 8 while holding the chord 4 stationary until the desired goal width is reached. The twisting action varies the length of chord 4 that remains within the spring 8, changing the size of the goal. When the amount of exposed chord 4 has been lengthened or shortened to the desired goal size, the springs 8 are set perpendicular to the ground and the attached suction cups 10 are pressed into place on the base 12.

For indoor use the suction cups 10 are set directly on the floor. For storage purposes the chord 4 can be twisted as far as possible into the center of the spring 8 coils. This action reduces the goal's storage size to a minimum.

Once set, the unique operation of the goal is a product of the flexible materials of which it is constructed. The secure placement of the chord 4 and its attached staple 6 within the spring 8 coils enables the goal to maintain structural integrity while still providing the desired flexibility. The springs 8 hold the chord 4 in an arc and together form the goal mouth, while the suction cups 10 serve to maintain the attachment to the base 12 or floor. In the course of play the goal simply remains stationary. When struck or fallen into, the chord 4 and the springs 8 give way. The elastic nature of the chord and the spring return the goal to its original upright position.

SUMMARY

Although the above described goal was originally developed to play soccer within the confines of a racquetball or four-sided handball court, the specificities that apply to a single game should not be construed as limiting the scope of the invention. The goal has significant advantages that make it useful for practicing or playing a wide range of sports. The goal's benefits of providing a safe, flexible structure with two open sides can be applied to practice techniques for many existing games and can be used as a basis for creating new games. The adaptable structure for both indoor or outdoor use, as well as the ease of setup, movement and storage, open the goal to uses previously not considered by coaches and teachers because of constraints with cost, setup and storage.

I claim:

1. A game goal apparatus comprising:

(a) a round chord made of elastic materials and (b) two springs having an interior diameter equal to or slightly larger than the diameter of said chord, and (c) two staples, one crimped at each end of said chord, the length of said staple being greater than the interior diameter and less than the exterior diameter of said springs and (d) two suction cups and (e) two base pieces composed of a flat, smooth surfaced material on one side and on the opposite side of each said base piece is extended a plurality of spikes.

2. A game goal apparatus according to claim 1 wherein the said chord is disposed at each end into the hollow interior portion of each of said springs.

3. A game goal apparatus according to claim 1 wherein the position of said chord within said springs is secured by the position of said staples within said springs.

4. The game goal apparatus according to claim 1 wherein said suction cups are disposed into the hollow interior portion of said springs.

5. The game goal apparatus according to claim 1 wherein said suction cups are affixed to said base piece by means of the vacuum created by said suction cup.

6. The game goal apparatus of claim 1 includes padding of the outer surface of said springs.

* * * * *